US010380949B2

(12) United States Patent
Oyama

(10) Patent No.: US 10,380,949 B2
(45) Date of Patent: Aug. 13, 2019

(54) DISPLAY APPARATUS AND CONTROL METHOD OF THE SAME

(71) Applicant: CANON KABUSHIKI KAISHA, Tokyo (JP)

(72) Inventor: Yasufumi Oyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 82 days.

(21) Appl. No.: 15/175,594

(22) Filed: Jun. 7, 2016

(65) Prior Publication Data

US 2016/0365039 A1 Dec. 15, 2016

(30) Foreign Application Priority Data

Jun. 9, 2015 (JP) ..... 2015-116882

(51) Int. Cl.
*G09G 3/36* (2006.01)
*G09G 3/34* (2006.01)

(52) U.S. Cl.
CPC ... *G09G 3/3406* (2013.01); *G09G 2320/0606* (2013.01); *G09G 2320/0626* (2013.01)

(58) Field of Classification Search
CPC ... G09G 2320/0606; G09G 2320/0626; H04N 5/23245; H04N 5/23222; H04N 5/23293; H04N 5/2353
USPC ..... 345/102
See application file for complete search history.

(56) References Cited

U.S. PATENT DOCUMENTS

2006/0187332 A1* 8/2006 Seki ..... G09G 3/3406 348/333.01
2015/0054965 A1* 2/2015 Sudo ..... H04N 5/23219 348/169
2015/0189180 A1* 7/2015 Sudo ..... H04N 5/23245 348/222.1

FOREIGN PATENT DOCUMENTS

JP 2006227187 A 8/2006
JP 5188010 B2 4/2013
JP 2015-040966 A 3/2015
JP 2015073229 A 4/2015

OTHER PUBLICATIONS

Notification of Reasons for Refusal issued by the Japanese Patent Office dated Feb. 18, 2019 in corresponding Japanese Patent Application No. 2015-116882, with English translation.

* cited by examiner

*Primary Examiner* — Roy P Rabindranath
(74) *Attorney, Agent, or Firm* — Carter, DeLuca & Farrell LLP

(57) ABSTRACT

A display apparatus comprises a display unit, a display control unit configured to perform control such that a plurality of items including a specific item for setting a dark place display mode are displayed on the display unit, a setting unit configured to set the dark place display mode based on an operation that includes an operation of selecting the specific item among the plurality of items displayed on the display unit, and a control unit configured to, in a case where the dark place display mode is set, perform control to release the dark place display mode according to a specific operation excluding an operation of selecting any of the plurality of items displayed on the display unit.

27 Claims, 6 Drawing Sheets

DISPLAY APPARATUS AND CONTROL METHOD OF THE SAME

BACKGROUND OF THE INVENTION

Field of the Invention

The present invention relates to a display apparatus that has a function of switching to any of a plurality of display modes including a dark place display mode, and a method of controlling the same.

Description of the Related Art

There are conventional display apparatuses that change the screen display luminance and display content according to the ambient brightness. As an example of conventional technology related to this, Japanese Patent No. 5188010 proposes a technique in which, when a long press is performed on a predetermined operation member, the display luminance of the screen is set to the highest level, thus improving visibility in a situation in which the screen is difficult to view due to a high ambient brightness. Also, Japanese Patent Laid-Open No. 2015-040966 proposes a technique in which, in a dark place display mode, only the blue (B) component or both the blue component and the green (G) component of the screen are reduced, and the screen is displayed in a faded orange or brownish color so as to more easily maintain the dark adaptation of the user's vision and display the screen in a color suited to a dark place.

In dark place display modes, which are useful in a low ambient light situation, various ingenuities are implemented, such as setting the display luminance of the screen to the lowest level or setting the display color to a reddish color that does not impair dark adaptation in people. However, if the power supply of the display apparatus is turned off in a state in which the dark place display mode has been set, the display apparatus will be started up in the dark place display mode the next time the power supply is turned on, and therefore it is envisioned that the screen will be difficult to view or nearly impossible to view in a place with a high ambient brightness, such as outdoors. In this case, the user will find it difficult or impossible to view the screen, and therefore it is conceivable that the user will try to make a setting change in an attempt to release the dark place display mode. However, the display mode is often set using a menu screen represented in a GUI, and therefore making the setting change is difficult when the screen is difficult to view.

SUMMARY OF THE INVENTION

The present invention has been made in consideration of the aforementioned problems, and realizes a display control technique in which a display mode setting change can be easily made even if the display unit is difficult to view due to the screen being displayed in the dark place display mode.

In order to solve the aforementioned problems, the present invention provides a display apparatus comprising: a display unit; a display control unit configured to perform control such that a plurality of items including a specific item for setting a dark place display mode are displayed on the display unit; a setting unit configured to set the dark place display mode based on an operation that includes an operation of selecting the specific item among the plurality of items displayed on the display unit; and a control unit configured to, in a case where the dark place display mode is set, perform control to release the dark place display mode according to a specific operation excluding an operation of selecting any of the plurality of items displayed on the display unit.

In order to solve the aforementioned problems, the present invention provides a display apparatus comprising: a display unit; a setting unit configured to set a dark place display mode; and a control unit configured to, in a case where the dark place display mode is not set by the setting unit, perform control to increase a display brightness of the display unit according to a specific operation being performed, and in a case where the dark place display mode is set by the setting unit, perform control to release the dark place display mode according to the specific operation being performed.

In order to solve the aforementioned problems, the present invention provides a control method of a display apparatus comprising: displaying, on a display unit, a plurality of items including a specific item for setting a dark place display mode; setting the dark place display mode based on an operation that includes an operation of selecting the specific item among the plurality of items displayed on the display unit; and performing control to, in a case where the dark place display mode is set, release the dark place display mode according to a specific operation excluding an operation of selecting any of the plurality of items displayed on the display unit.

In order to solve the aforementioned problems, the present invention provides a control method of a display apparatus comprising: setting a dark place display mode by a setting unit; and performing control to, in a case where the dark place display mode is not set by the setting unit, increase a display brightness of a display unit according to a specific operation being performed, and performing control to, in a case where the dark place display mode is set by the setting unit, release the dark place display mode according to the specific operation being performed.

In order to solve the aforementioned problems, the present invention provides a non-transitory computer-readable storage medium storing a program for causing a computer to function as a display control unit and a setting unit and a control unit of a display apparatus, wherein the display control unit performs control such that a plurality of items including a specific item for setting a dark place display mode are displayed on a display unit, the setting unit sets the dark place display mode based on an operation that includes an operation of selecting the specific item among the plurality of items displayed on the display unit, and the control unit, in a case where the dark place display mode is set, performs control to release the dark place display mode according to a specific operation excluding an operation of selecting any of the plurality of items displayed on the display unit.

In order to solve the aforementioned problems, the present invention provides a non-transitory computer-readable storage medium storing a program for causing a computer to function as a setting unit and a control unit of a display apparatus, wherein the setting unit sets a dark place display mode, and the control unit, in a case where the dark place display mode is not set by the setting unit, performs control to increase a display brightness of a display unit according to a specific operation being performed, and in a case where the dark place display mode is set by the setting unit, perform control to release the dark place display mode according to the specific operation being performed.

According to the present invention, a display mode setting change can be easily made even if the display unit is difficult to view due to the screen being displayed in the dark place display mode.

Further features of the present invention will become apparent from the following description of exemplary embodiments (with reference to the attached drawings).

DESCRIPTION OF THE EMBODIMENTS

Embodiments in which a display apparatus according to the present invention is applied to a digital camera that has a function of switching to any of a plurality of display modes including a dark place display mode and that is capable of shooting still images and moving images will be described below in detail with reference to accompanied drawings.

The dark place display mode (a night display mode) of the present embodiment can be switched on and off by a user switching on and off a dark place display setting on a menu screen, and in a situation in which the screen is difficult to view due to high ambient brightness, the user can release the dark place display setting by operating a specific operation member.

Dark place display can be set using a menu item in an astronomy shooting mode, a program AE mode, an aperture priority mode, a shutter speed priority mode, a manual mode, a night scene shooting mode, and a fireworks shooting mode, which are modes in which it is envisioned that shooting will be performed in a dark place.

Apparatus Configuration

The appearance and functions of a digital camera according to the present embodiment will be described below with reference to FIGS. 1 and 2.

Figure 1:
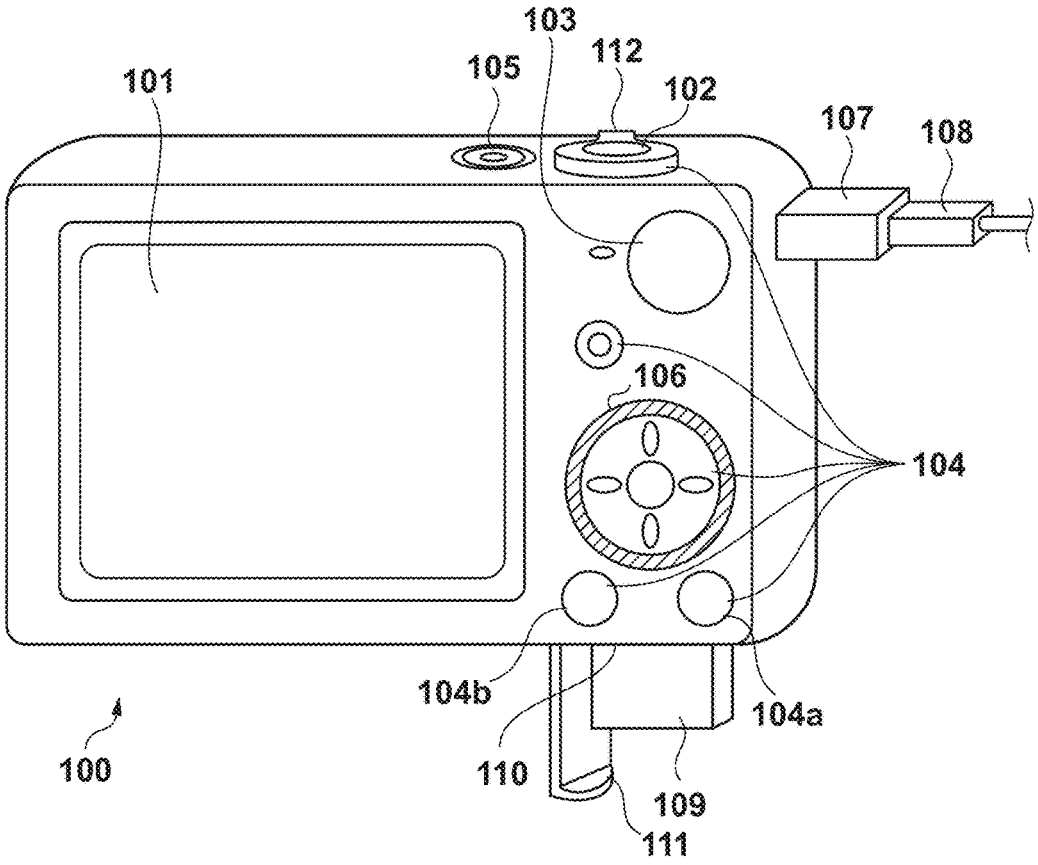
FIG. 1 is a back view of an external appearance of an image capturing apparatus according to a present embodiment.

In FIG. 1 which shows an external appearance of a digital camera 100 according to the present embodiment, a display unit 101 is comprised of a liquid crystal display panel (LCD) for displaying images and various information, or the like. A shutter button 102 is an operation unit for giving a shooting instruction. A mode switching button 103 is an operation unit for changing over among various modes. A connector 107 is an interface that connects a connection cable 108 with a digital camera 100. Operation units 104 comprise operation members such as various switches, buttons, and a touch panel operated in various ways by the user. A controller wheel 106 is a rotatable electronic dial included among the operation units 104. A power switch 105 switches between power on and power off.

A DISP button 104*a* is an operation member for switching the display mode and is included among the operation units 104. The DISP button 104*a* is a physical push button switch, and is an operation member that the user can operate without viewing the screen, unlike software switches and the like that are displayed on the touch panel integrated in the display unit 101. The arrangement of the DISP button 104*a* is not limited to the position shown in the drawings, and the function of this DISP button may be allocated to a down button among four-direction buttons, for example. A MENU button 104*b* is an operation member for displaying a menu screen, and is included among the operation units 104.

A recording medium 109 is a medium such as a memory card or hard disk. A recording medium slot 110 is for accommodating the recording medium 109. The recording medium 109 accommodated in the recording medium slot 110 can communicate with the digital camera 100. A cover 111 covers the recording medium slot 110. A zoom lever 112 included in the operation units 104 is a zoom instruction member that can move to the left and right in order for the user to give an instruction for performing a zoom operation with the photographing lens 203, and the photographing lens 203 can be driven to the TELE side if the zoom lever is moved in one direction, and be driven to the WIDE side if the zoom lever is moved in the other direction. Note that left and right buttons among the four-direction buttons, namely up, down, left, and right, may be caused to function as zoom buttons.

Figure 2:
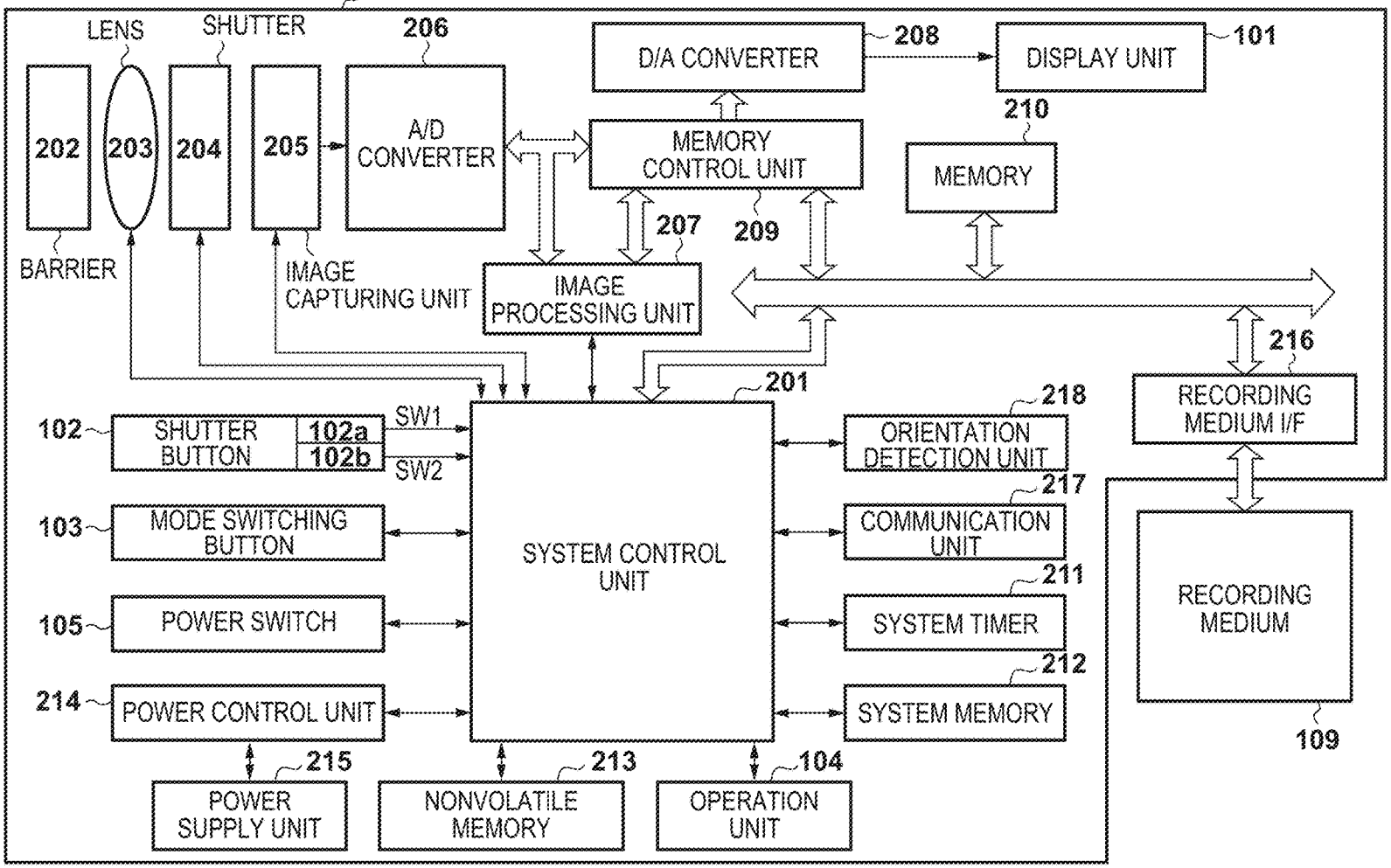
FIG. 2 is a block diagram showing a configuration of an image capturing apparatus according to the present embodiment.

In FIG. 2 which shows an internal configuration of the digital camera 100 according to the present embodiment, a photographing lens 203 includes a zoom lens and a focusing lens. A shutter 204 has a diaphragm function. An image capturing unit 205 is an image sensor, which is constituted by a CCD or CMOS or the like, for converting the optical image of an object to an electric signal. An A/D converter 206 converts an analog signal to a digital signal. The A/D converter 206 is used to convert an analog signal, which is output from the image capturing unit 205, to a digital signal. A barrier 202 covers the image capturing system (which includes the photographing lens 203) of the digital camera 100, thereby preventing contamination of and damage to the image capturing system that includes the photographing lens 203, shutter 204 and image capturing unit 205.

An image processing unit 207 performs resizing processing, such as predetermined pixel interpolation and reduction, and color conversion processing, with respect to data from the A/D converter 206 or data from a memory control unit 209. Further, the image processing unit 207 performs predetermined calculation processing using the captured image data, and the system control unit 201 performs exposure control and distance measuring control based on the calculation results. Thus, AF (Automatic Focus) processing, AE (Automatic Exposure) processing, and EF (flash pre-emission) processing of TTL (Through the Lens) type are performed. Furthermore, the image processing unit 207 performs predetermined calculation processing using the captured image data, and AWB (Automatic White Balance) processing of TTL type is performed on the basis of the calculation results.

The output data from the A/D converter 206 is directly written into a memory 210 via both the image processing unit 207 and the memory control unit 209 or via the memory control unit 207. The memory 210 stores the image data obtained from the image capturing unit 205 and converted into digital data by the A/D converter 206, and image display data to be displayed on the display unit 101. The memory 210 has a storage capacity that is sufficient for storing a predetermined number of still images as well as moving images and audio for a predetermined time period.

The memory 210 also functions as a memory for image display (video memory). A D/A converter 208 converts the image display data stored in the memory 210 into an analog signal and supplies the display unit 101 with the analog signal. The image display data that was written into the memory 210 is displayed by the display unit 101 via the D/A converter 208. The display unit 101 performs, on a display device such as an LCD, display in accordance with the analog signal from the D/A converter 208. The digital signal once converted by A/D conversion of the A/D converter 206 and stored in the memory 210 is converted into an analog signal by the D/A converter 208, and the analog signals are successively transmitted to the display unit 101 so as to be displayed thereon, making it possible to realize an electronic view finder (EVF) functionality and to perform through the lens image display by a live view.

A nonvolatile memory 213 is, for example, an EEPROM, which is electrically erasable and recordable. In the nonvolatile memory 213, constants and programs, for example, for operating the system control unit 201 are stored. In this context, "programs" may refer to programs for executing various flowcharts that will be described later.

The system control unit 201 performs overall control of the digital camera 100. It realizes, by executing the programs stored in the nonvolatile memory 213, the procedures of the flowchart that will be described later. The system memory 212 is, for example, a RAM. The system memory 212 is where constants and variables for operating the system control unit 201, and the programs read out from the nonvolatile memory 213 are expanded. The system control unit 201 controls the memory 210, the D/A converter 208, the display unit 101, and the like, so as to perform display control.

A system timer 211 is a timer circuit for measuring time periods for various types of controls and the time of an integrated clock.

A mode switching button 103, a first shutter switch 102*a*, a second shutter switch 102*b*, and the operation units 104 are operation members for inputting various types of instructions into the system control unit 201.

The mode switching button 103 switches the operation mode of the system control unit 201 to any of a still image shooting mode, a moving image recording mode, and a reproduction mode. The still image shooting mode includes an automatic shooting mode, an automatic scene determination mode, a manual mode, scene-specific shooting modes, a program AE mode, a custom mode, and the like. Using the mode switching button 103, the mode is directly switched to any of the plurality of modes included in the still image shooting mode. Alternatively, it is also possible to switch, using the mode switching button 103, to the still image shooting mode and then to switch, using another operation member, to any of the plurality of modes included in the still image shooting mode. Similarly, the moving image recording mode may also include a plurality of modes.

While the shutter button 102 provided on the camera 100 is being operated, that is, pressed half-way (the shooting preparation instruction), the first shutter switch 102*a* is turned on and generates a first shutter switch signal SW1. Upon receiving the first shutter switch signal SW1, the system control unit 201 causes the image processing unit 207 to start the AF (Automatic Focus) processing, the AE (Automatic Exposure) processing, the AWB (Automatic White Balance) processing, the EF (flash pre-emission) processing and the like.

When the operation of the shutter button 102 is completed, that is, the shutter button 102 is pressed fully (the shooting instruction), the second shutter switch 102*b* is turned on and generates a second shutter switch signal SW2. Upon receiving the second shutter switch signal SW2, the system control unit 201 starts a series of shooting processing from reading out the signal from the image capturing unit 205 to writing of image data to the recording medium 109.

By selecting various functional icons displayed on the display unit 101, appropriate functions for each situation are assigned to the operation units 104, and the operation units 104 thus act as various function buttons. Examples of these function buttons include an end button, a back button, an image scrolling button, a jump button, a narrow-down button, and an attribute change button. For example, a notification for a menu switching instruction is given and a menu screen that enables various settings to be made is displayed on the display unit 101 by pressing a menu button. The user can make various settings intuitively by using the menu screen, which is displayed on the display unit 101, four-direction (up, down, left, right) buttons and a SET button.

Included among the operation units 104 is also a touch panel that is capable of detecting a touch operation on the display unit 101. The touch panel and the display unit 101 can be constructed as a single integrated unit. For example, the touch panel is constructed in such a manner that the transmittance of light will not interfere with the display presented by the display unit 101, and it is attached to the uppermost layer of the display face of the display unit 101. In addition, input coordinates on the touch panel and display coordinates on the display unit 101 are correlated. As a result, a GUI can be constructed that makes it possible for the user to directly manipulate the screen displayed on the display unit 101.

The controller wheel 106, which is a rotatable operation member included among the operation units 104, is used together with the direction buttons as when a selection item is specified. When the controller wheel 106 is turned, an electrical pulse signal is generated in accordance with the amount of rotation, and the system control unit 201 controls each unit of the digital camera 100 based upon the pulse signal. The angle through which the controller wheel 106 has been turned and how many times it has been turned can be determined by the pulse signal. It should be noted that the controller wheel 106 can be any operating member so long as it is an operating member whose rotation can be detected. For example, it can be a dial operating member in which the controller wheel 106 per se is rotated to generate the pulse signal in accordance with a turning operation by the user. Further, it can be a device (a so-called touch wheel) that detects an operation such as the revolution of the user's finger on the controller wheel 106 without the controller wheel 106 itself being rotated.

A power control unit 214 is constituted by, for example, a battery detection circuit, a DC-DC converter, and a switch circuit for changing over the block to be supplied with power, and detects whether a battery has been inserted or not, the type of the battery, and the residual capacity thereof. Further, the power control unit 214 controls the DC-DC converter in accordance with the detection results and an instruction of the system control unit 201, and supplies a necessary voltage for a necessary length of time to each of the units including the recording medium 109.

A power supply unit 215 comprises a primary battery such as an alkaline battery or a lithium battery, a secondary battery such as an NiCd battery, an NiMH battery, or an Li-ion battery, or an AC adaptor. The recording medium interface (I/F) 216 is for interfacing with the recording medium 109 such as the memory card or hard disk. The recording medium 109 is a recording medium such as a memory card for recording shot images, and is constituted by a semiconductor memory, a magnetic disk, or the like.

A communication unit 217 performs transmitting/receiving video and sound to/from an external device communicably connected via a wireless antenna or wired cable. The communication unit 217 is also connectable to a wireless LAN (Local Area Network) and the Internet. The communication unit 217 can transmit an image (including a through the lens image) captured by the image capturing unit 205 and an image file recorded in the recording medium 109 to an external device, and receive image data and other various kinds of information from an external device.

An orientation detection unit 218 detects the orientation of the digital camera 100 with respect to the gravity direction. In this case, based on the orientation detected by the orientation detection unit 218, it is possible to discriminate whether an image captured by the image capturing unit 205 has been shot by setting the digital camera 100 in the landscape or portrait direction. The system control unit 201 can add information about the orientation detected by the orientation detection unit 218 to the image data obtained by the image capturing unit 205, and rotate and record the captured image. An acceleration sensor, gyro sensor and the like may be used as an orientation detection unit.

Note that the hardware configuration is not limited to that shown in FIG. 2, and a configuration is also possible in which, for example, a single item of hardware performs display control, communication control, shooting control, image processing control, and the like, so as to function as each unit or block of the digital camera 100. Alternatively, it is also possible that a plurality of items of hardware operate in cooperation with each other to function as a single unit or block.

In the digital camera 100 of the present embodiment, the display mode is switched each time the user performs an operation of pressing the DISP button 104*a* and then releasing it before a predetermined time period elapses (hereinafter, referred to as a short press). Also, the following modes are examples of display modes during live view in the still image shooting mode or the moving image recording mode.

Figure 4A:
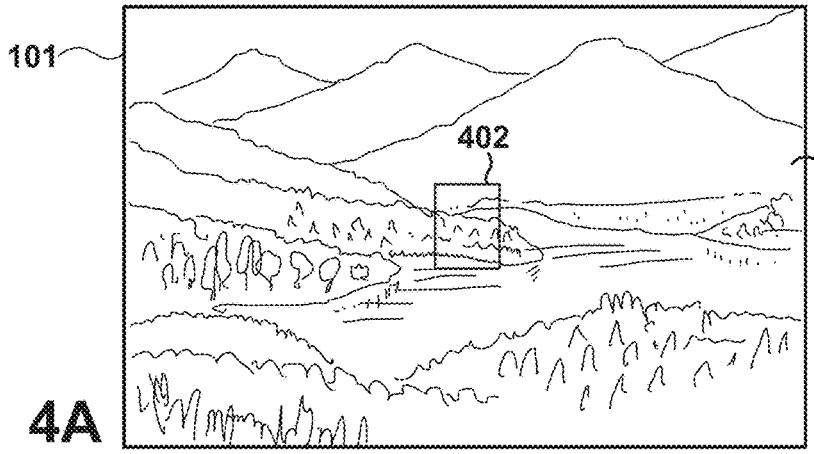
FIGS. 4A to 4C are diagrams illustrating display screens in a live view according to the present embodiment.

(1) Display mode 1: as shown in FIG. 4A, only a through the lens image 401 and information regarding the focus position (focus frame 402) are displayed. A configuration is possible in which only the through the lens image 401 is displayed.

Figure 4B:
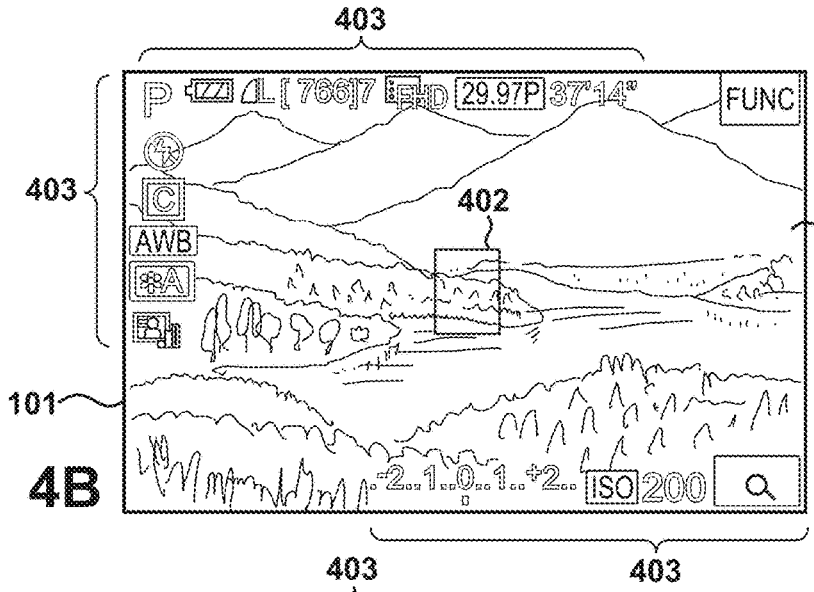

(2) Display mode 2: simple information is displayed as shown in FIG. 4B. Components displayed superimposed on the through the lens image 401 include the focus frame 402 and information 403 such as an icon indicating the current shooting mode type, the residual battery capacity, the remaining number of images that can be captured, and the current shooting settings (e.g., image size, compression rate, aperture, shutter speed, ISO sensitivity, exposure correction, white balance setting, and flash setting).

Figure 4C:
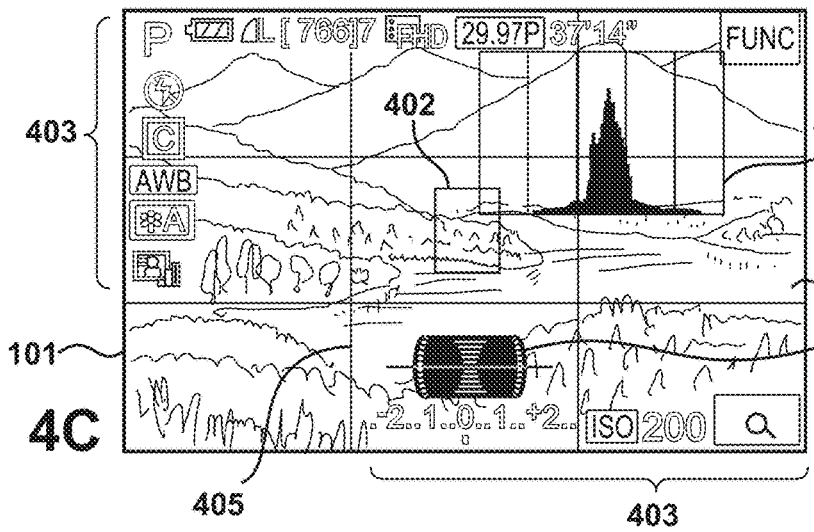

(3) Display mode 3: detailed information is displayed as shown in FIG. 4C. In addition to the focus frame 402 and the information 403 displayed in the display mode 2, information such as a level (display indicating camera tilt) 404, grid lines 405, and a display luminance histogram 406 are displayed superimposed on the through the lens image 401.

The types of displayed information and the number of pieces thereof are different in each of the above-described display modes 1 to 3. Each time the DISP button 104*a* is short-pressed, the display mode is switched in the order of display mode 1→display mode 2→display mode 3→display mode 1. Similarly, in the reproduction mode as well, there are multiple display modes in which different types and numbers of pieces of information are displayed along with reproduced images, and each time the DISP button 104*a* is short-pressed during image reproduction in the reproduction mode, the display mode in the reproduction mode is switched.

Also, in the digital camera 100 of the present embodiment, the normal display mode and a light place display mode are switched each time the user performs an operation of pressing the DISP button 104*a* and then releasing it after a predetermined time period has elapsed (hereinafter, referred to as a long press). The normal display mode is a normal display state that is displayed first after the power supply is turned on, and display is performed with a display luminance level that corresponds to a display luminance setting value that was set by the user in a display luminance setting item included in a menu screen. For example, it is assumed that in the display luminance setting item, it is possible to select one of seven levels, namely display luminance setting values 1 to 7 (1 being dark and 7 being bright) that correspond to display luminance levels. For example, if the user selected the display luminance setting value "4" in this setting item, information indicating "4" is stored in the nonvolatile memory 213. In the normal display mode, the display luminance setting value ("4") stored in the nonvolatile memory 213 is read out, and display is performed with the display luminance level that corresponds to the display luminance setting value.

The light place display mode is a light place display state in which display is performed with the brightest display luminance level among the display luminance levels that can be selected in the setting item. In the case where the above-described seven display luminance levels can be selected, in the light place display mode, display is performed with the display luminance level that corresponds to the display luminance setting value "7", regardless of the display luminance setting value that has already been set by a user operation and is stored in the nonvolatile memory 213. In other words, in the light place display mode, display is performed with the display luminance level that corresponds to "7" even if the display luminance setting value that has already been set is "4" out of the seven levels. In the present embodiment, display luminance refers to the brightness of the backlight in the case where the display unit 101 is an LCD, for example, but it refers to the brightness of self-luminescence in the case of a self-luminescent display such as an organic EL display.

Figure 5A:
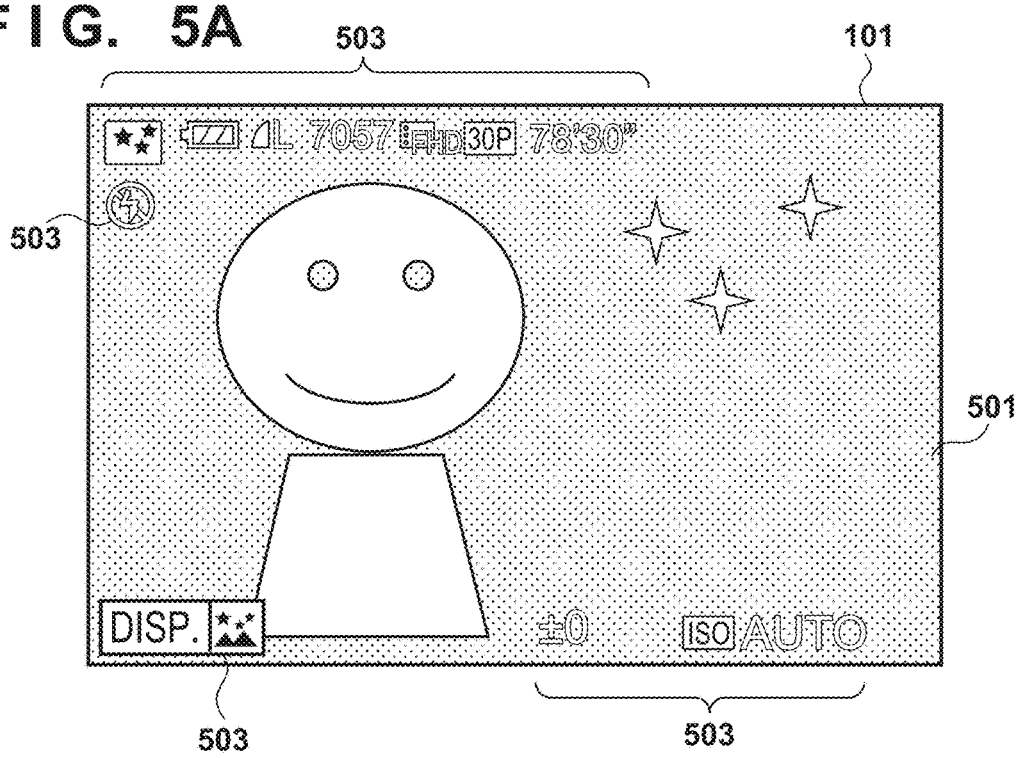
FIG. 5A is a diagram illustrating display screens in a normal display mode according to the present embodiment.
Figure 5B:
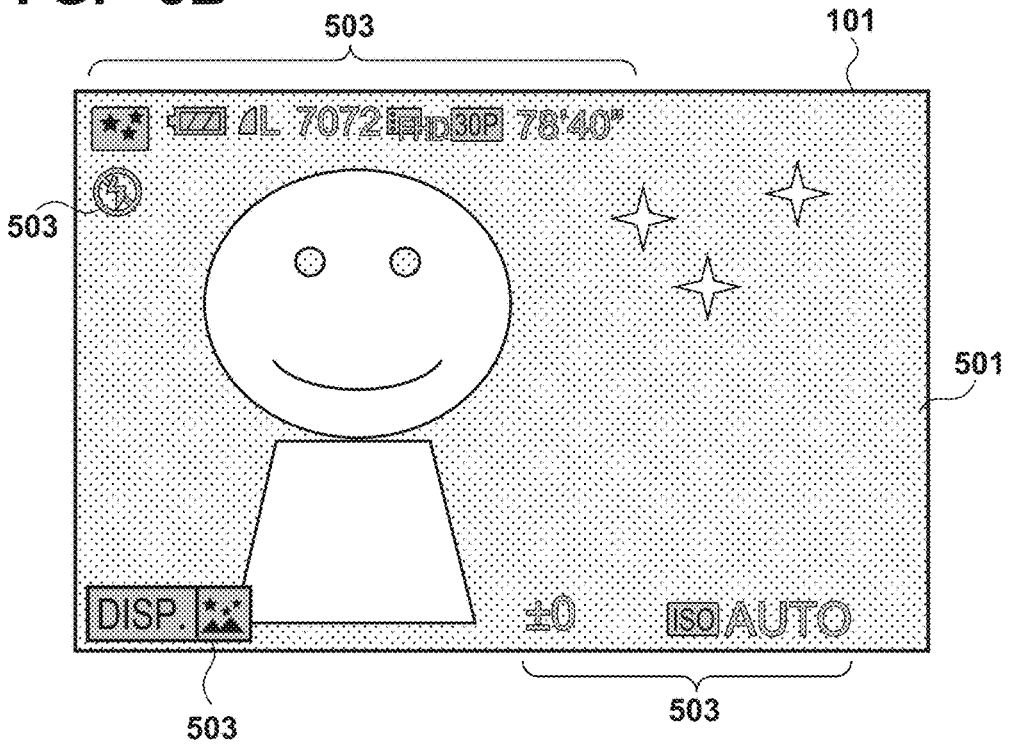
FIG. 5B is a diagram illustrating display screens in a dark place display mode according to the present embodiment.

Also, the setting items displayed in the menu items displayed when the MENU button 104*b* is pressed includes also an item for setting the dark place display mode, and thus the dark place display mode can be set by a user operation. FIG. 5A shows an example of a display screen during live viewing in the normal display mode (dark place display setting OFF), and the display mode described with reference to FIGS. 4A to 4C has been set to the display mode 2, for example. In FIG. 5A, various types of information (display items) 503 are displayed in the color white (the gain is the same for each of the RGB color components) and are superimposed on a through the lens image 501 on the display unit 101. FIG. 5B shows an example of a display screen during live viewing in the dark place display mode (dark place display setting ON). The various types of information (display items) 503 that are superimposed on the through the lens image 501 on the display unit 101 are subjected to color conversion suitable to a dark place by applying gain to the R (red), G (green), and B (blue) color components so as to be displayed in an orange-ish color. When shooting in a low ambient light situation at night for astronomical observation or the like, there is known to be a phenomenon in which the user's eyes become accustomed to the surrounding darkness so as to be able to see things (dark adaptation). Light with wavelengths near blue easily impair dark adaptation, and therefore it is effective to reduce the amount of light with wavelengths near blue in visible light when performing display in order to maintain dark adaptation. In other words, the impairment of dark adaptation can be suppressed by performing display with a suppressed blue (B) component out of the RGB color components (by performing reduced-blue display).

In the present embodiment, in the dark place display mode (dark place display setting ON), only the B component or both the B component and the G component of the various types of information (display items) displayed on the display unit 101 is/are reduced so as to be displayed in a faded orange or brownish color. Doing this facilitates maintaining dark adaptation of the user's vision and makes it possible to perform display with a color suitable to a dark place. Note that besides a method of performing dark place display by adjusting the gain of the RGB colors of the various types of information (display items), dark place display may be performed by displaying a screen that includes display items in a red or orange color that is different from the case of not performing dark place display. Also, in the dark place display mode, the hue is changed, and the display luminance is set lower than in the normal display mode.

Display Mode Setting/Release Processing

Next, display mode setting/release processing in the camera 100 of the present embodiment will be described with reference to FIGS. 3A and 3B.

Figure 3A:
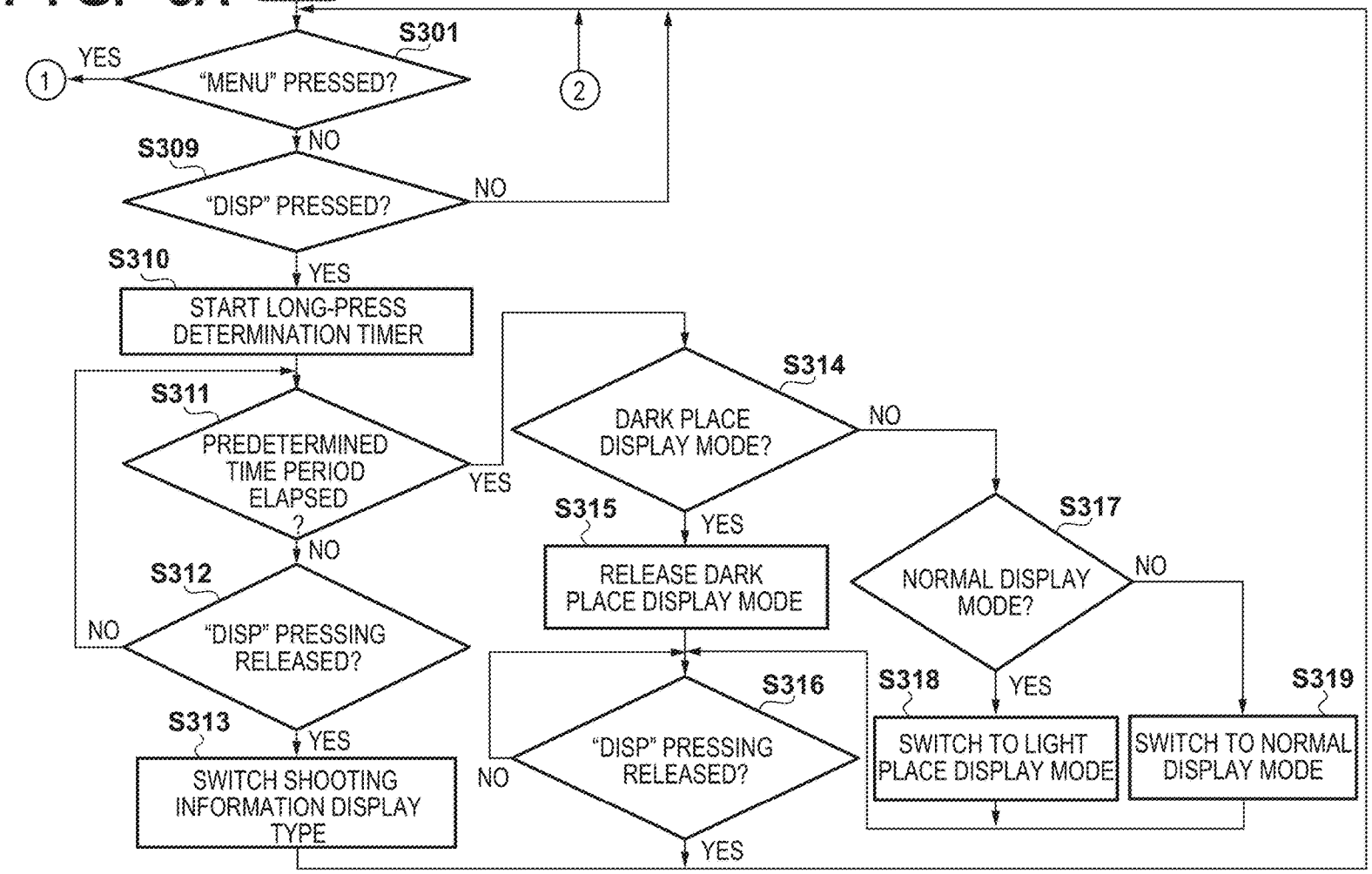
FIGS. 3A and 3B are flowcharts showing setting change processing of a display mode according to the present embodiment.
Figure 3B:
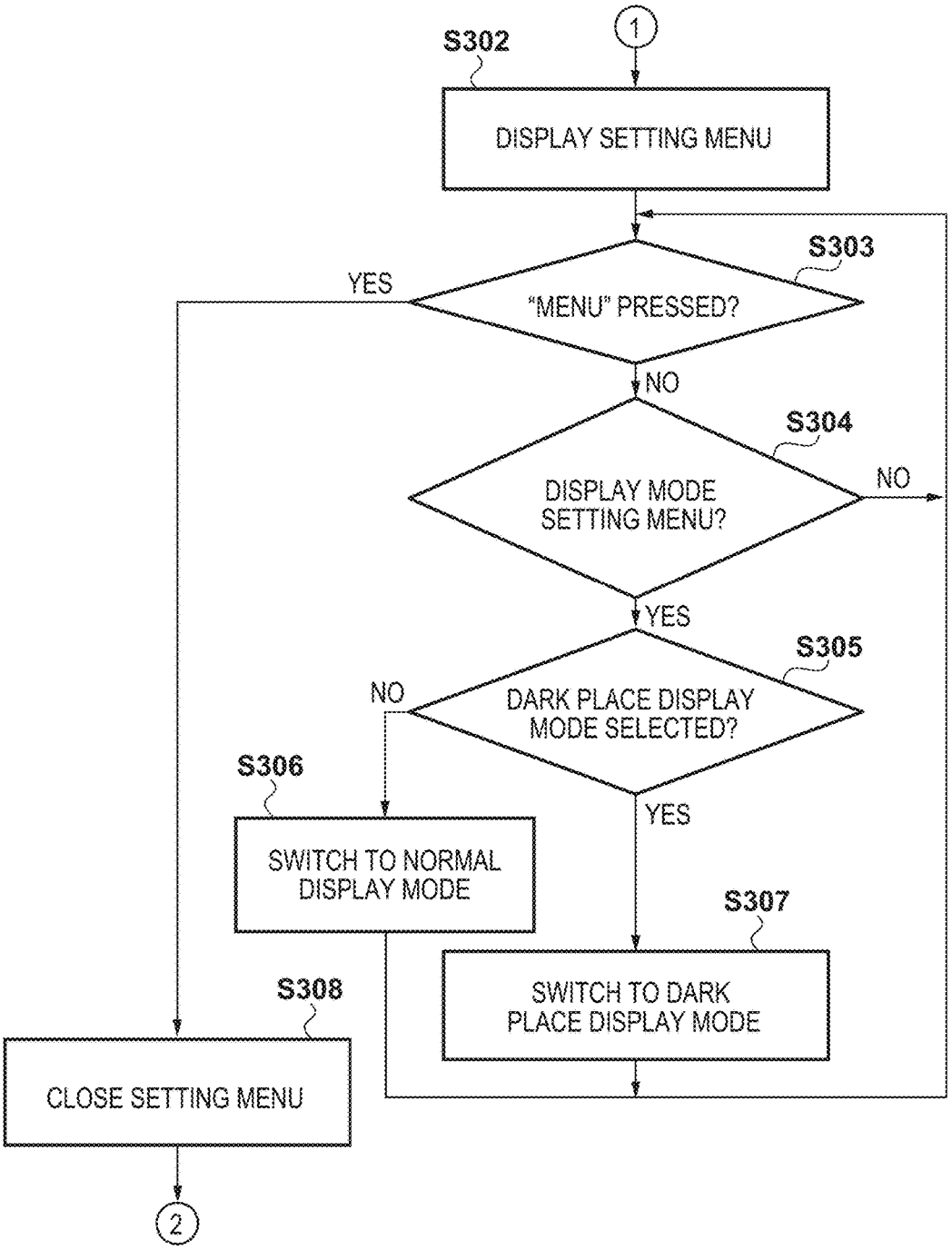

The processing in FIGS. 3A and 3B shows processing in which the dark place display mode is set by turning on the dark place display setting among the setting items in the menu items displayed on the display unit 101, and the dark place display mode is released by long-pressing the DISP button 104*a*.

Also, in the processing in FIGS. 3A and 3B, the digital camera 100 is started up in the shooting mode, and live view images are displayed with a display luminance corresponding to the normal display mode, or the digital camera 100 is started up in the reproduction mode, and images are reproduced with a display luminance corresponding to the normal display mode. Note that whether or not display is to be performed in the dark place display mode when the camera is started up depends on the display mode setting that was in effect immediately before the power was turned off, and the camera is started up in the dark place display mode if the dark place display mode had been set previously.

Note that the processing in FIGS. 3A and 3B is realized by a program stored in the nonvolatile memory 213 being deployed to the system memory 212 and executed by the system control unit 201.

In step S301, the system control unit 201 determines whether or not the MENU button 104*b* was pressed, proceeds to step S302 if it was pressed, and otherwise proceeds to step S309.

In step S302, the system control unit 201 displays a menu screen on the display unit 101.

In step S303, the system control unit 201 determines whether or not the MENU button 104*b* was pressed, proceeds to step S308 if it was pressed, and proceeds to step S304 if a predetermined time period has elapsed without it being pressed.

In step S308, the system control unit 201 ends the display of the menu screen and returns to step S301. In this case, the digital camera 100 returns to the live view screen display state if the current mode is the shooting mode, and returns to the reproduced image display state if the current mode is the reproduction mode.

In step S304, the system control unit 201 determines whether the dark place display mode setting item was selected among the setting items in the menu items, proceeds to step S305 if the dark place display mode setting item was selected, and otherwise returns to step S303. The up and down directional keys or the like included among the operation units 104 can be used to select the dark place display mode setting item from among the setting items in the menu items in the menu screen displayed on the display unit 101. This operation performed on the screen is difficult for the user in a situation in which the display unit 101 is difficult to view.

In step S305, the system control unit 201 displays the dark place display mode menu item, determines whether or not dark place display was turned on by a user operation, proceeds to step S307 if dark place display was turned on, and proceeds to step S308 if an operation for turning dark place display off was performed. The two setting items "ON" and "OFF" are selectably displayed in the dark place display mode menu item, and the dark place display setting can be turned on or off by the user selecting "ON" or "OFF" using the left and right direction keys or the like included among the operation units 104. This operation performed on the screen is difficult for the user in a situation in which the display unit 101 is difficult to view.

In step S307, the system control unit 201 sets the dark place display mode because dark place display was turned on, and stores information indicating that dark place display was turned on in the nonvolatile memory 213. The dark place display mode is switched to at this point in time, and the displayed menu screen is also changed to a reddish display form.

In step S306, the system control unit 201 releases the dark place display mode because dark place display was turned off, and stores information indicating that dark place display was turned off in the nonvolatile memory 213. There is a switch from the dark place display mode to the normal display mode at this point in time, and the reddish display state is changed to the normal color display state.

In step S309, the system control unit 201 determines whether or not the DISP button 104*a* was pressed, proceeds to step S310 if it was pressed, and otherwise returns to step S301.

In step S310, the system control unit 201 starts a long press determination timer for determining whether or not the DISP button 104*a* was long-pressed.

In step S311, the system control unit 201 determines whether or not a predetermined time period has elapsed while the DISP button 104*a* is in the pressed state, based on the count value of the long press determination timer that was started in step S310. The system control unit 201 proceeds to step S312 if the result of the determination is that the predetermined time period has not elapsed, and proceeds to step S314 if the predetermined time period has elapsed (i.e., if a long press was performed).

In step S312, the system control unit 201 determines whether or not the pressing of the DISP button 104*a* was released, proceeds to step S313 if it was released, and returns to step S311 if it was not released. Here, if it was determined that the pressing was released, it is determined that a short press was performed because the predetermined time period has not elapsed since the DISP button 104*a* was pressed in step S309.

In step S313, the system control unit 201 switches the display mode in accordance with the short press of the DISP button 104*a*.

In step S314, the system control unit 201 determines whether or not the DISP button 104*a* was long-pressed, determines whether or not the current display mode is the dark place display mode (whether or not dark place display is on), proceeds to step S315 if the current display mode is the dark place display mode, and otherwise proceeds to step S317.

In step S315, the system control unit 201 releases the dark place display mode and switches to the normal display mode. Specifically, the information stored in the nonvolatile memory 213 that indicates that dark place display was set to on is changed to off. By doing this, there is a switch from the dark place display mode shown in FIG. 5B to the normal display mode shown in FIG. 5A, which is not dark place display. In this way, in the digital camera 100 of the present embodiment, if the DISP button 104*a* is long-pressed while the dark place display mode is set, the dark place display mode is released. Note that in this case, the display luminance level setting is not changed (a switch between the normal display mode and the light place display mode is not performed). In this way, the dark place display mode can be released by merely long-pressing the DISP button 104*a*, which is a physical push button switch, without viewing the display unit 101. Accordingly, even in the case where the screen is difficult to view while display is being performed in the dark place display mode in a high ambient light situation, it is possible to easily release the dark place display mode without viewing the menu screen of the display unit 101, and change to a display with normal colors that are easy to see. At this time, a change in the display luminance level (a switch between the normal display mode and the light place display mode) is not made.

In step S316, the system control unit 201 waits until the pressing of the DISP button 104*a* is released, returns to step S301 when the pressing is released, and repeats the above processing.

In step S317, because the current display mode is a display mode other than the dark place display mode, the system control unit 201 determines whether or not the display luminance level is the normal display mode or the light place display mode, proceeds to step S318 in the case of the light place display mode, and proceeds to step S319 in the case of the normal display mode.

In step S318, the system control unit 201 changes to the light place display mode (performs display with the brightest display luminance level among the display luminance levels that can be selected in the setting item). By doing this, even if the display unit 101 is difficult to view due to high ambient light, it is possible to improve the visibility of the display unit 101 by performing display with the maximum display luminance.

In step S319, the system control unit 201 releases the light place display mode and changes to the normal display mode. Specifically, the display luminance level is changed to the display luminance level that was set by a user operation. In this way, the operation for changing from the normal display mode to the light place display mode and the operation for releasing the light place display mode can be performed by performing the same operation (long-pressing the DISP button 104*a*).

According to the processing described above, it is possible to easily cause the system control unit 201 to release the dark place display mode by merely performing a long-press on the DISP button 104*a*, which is an operation performed on a single physical operation member that can be operated without viewing the screen. In this way, the dark place display setting can be released without using a method in which the operation is difficult to perform in a situation in which the screen is difficult to view, such as performing a setting change while the menu screen is displayed. In other words, it is possible to resolve a situation in which it is difficult to perform an operation on the menu screen and difficult to release the dark place display mode due to the dark place display setting being on and the display content on the display unit 101 being difficult to view.

Also, with a user who is accustomed to changing to the light place display mode when the display unit 101 is difficult to view in order to resolve the problem, when the display unit 101 is difficult to view due to the camera being started up in the dark place display mode in a bright location, it is possible that the user will first attempt to change the setting to the light place display mode. For this reason, if the dark place display mode can be released by long-pressing the DISP button 104*a*, which is an operation for switching between the normal display mode and the light place display mode, even a user who does not realize that the dark place display mode is the reason why the display unit 101 is difficult to view can possibly be able to release the dark place display mode and resolve the difficulty in viewing.

Also, the function of switching to any of the display modes 1 to 3, the function of switching between the normal display mode and the light place display mode, and the function of releasing the dark place display mode, which are all functions for changing the display mode, are collectively performed using the DISP button 104*a*. Accordingly, the user can be provided with an intuitive sense of operations, in which the DISP button 104*a* is somehow operated in order to change the display mode.

Note that an example was described in which the display luminance level is set to the normal display mode in step S315 for releasing the dark place display mode by long-pressing the DISP button 104*a*, but the display mode may be switched to the light place display mode in one step.

Also, although the example of releasing the dark place display mode by long-pressing the DISP button 104*a* is described in the present embodiment, the dark place display mode may be released using a means or method other than the present embodiment, as long as it is a means or method that enables releasing the dark place display mode without viewing the screen in a situation in which the display content on the display unit 101 is difficult to view. For example, the dark place display mode may be released by long-pressing an operation member that is included among the operation units 104 and is not the DISP button 104*a*. Also, it is possible to use an operation for shaking the digital camera 100 (the dark place display mode is released in accordance with detecting predetermined vibration by the orientation detection unit 218 of the digital camera 100), an operation for touching a predetermined place on the digital camera 100, voice recognition, a predetermined gesture operation performed using the touch panel, an operation for covering the touch panel screen with a hand, simultaneously pressing multiple operation members, or the like.

Note that although an example in which display is performed with the maximum display luminance among the display luminance levels that can be set in the light place display mode is described in the present embodiment, there is no limitation to this, and it is sufficient to perform display with a brighter display luminance than before the switch to the light place display mode (it is sufficient to raise the display luminance). For example, the light place display mode may be a state in which display is performed with a display luminance that is a setting value a predetermined number of levels (e.g., two levels) brighter than the setting value that was set as the display luminance level in the normal display mode, among the multiple levels (e.g., seven levels) of display luminance setting values.

Note that a single item of hardware may control the system control unit 201, or the entire apparatus may be controlled by a plurality of items of hardware sharing processing.

Although the present invention has been elaborated above based on suitable embodiments thereof, the present invention is by no means limited to these specific embodiments and includes various modifications without departing from the concept of the present invention.

Although the above embodiments have described an example in which the present invention is applied to an image capturing apparatus such as a digital camera, the present invention is not limited to this example. The present invention is applicable to, for example, an apparatus having a function of switching to any of a plurality of display modes including a dark place display mode. More specifically, the present invention is applicable to a personal computer, a tablet terminal which is a kind of a personal computer, a mobile telephone terminal, a smart phone (includes eyeglasses type terminal device and wrist watch type terminal devices) which is a kind of a mobile telephone terminal, a PDA (Personal Digital Assistant), a mobile image viewer, a printer device having a display function, a digital photo frame, a music player, a game console, an electronic book reader, and the like.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-116882, filed Jun. 9, 2015 which is hereby incorporated by reference herein in its entirety.

What is claimed is:

1. A display apparatus comprising:

a display;

an operation member; and at least one of: a memory and at least one processor, or at least one circuit, to perform operations of units including:

a display control unit configured to perform control such that a plurality of items, including a specific item for setting a display color change mode to keep a dark adaptation state of a user from being completely released, are displayed on the display;

a setting unit configured to set the display color change mode based on an operation that includes an operation of selecting the specific item among the plurality of items displayed on the display, wherein the display color change mode is a display mode in which a display color is changed from a mode which is not the display color change mode; and a control unit configured to, in a case where the display color change mode is set, perform control to release the display color change mode according to a specific operation on the operation member excluding an operation of selecting any of the plurality of items displayed on the display, wherein in a case in which the display color change mode is set, and a power supply of the display apparatus is turned off and then turned on again, the setting unit maintains setting of the display color change mode, and wherein in a case where the display color change mode is not set, the control unit performs control to increase a display brightness of the display according to the specific operation being performed, and in a case where the display color change mode is set, the control unit performs control to release the display color change mode according to the specific operation being performed.

2. The display apparatus according to claim 1, wherein in a case where the display color change mode is not set by the setting unit, the control unit does not allow the display color change mode to be set even if the specific operation is performed.

3. The display apparatus according to claim 1, wherein in a case where the display color change mode is set, the control unit performs control to release the display color change mode also according to an operation that is different from the specific operation and includes an operation of selecting the specific item from the plurality of items displayed on the display, and in a case where the display color change mode is not set by the setting unit, the control unit does not allow the display color change mode to be set even if the specific operation is performed.

4. The display apparatus according to claim 1, wherein the display control unit performs control to display a menu screen in which a plurality of setting items related to the display apparatus are displayed in a list, and the specific item is included in the plurality of setting items displayed in the menu screen.

5. The display apparatus according to claim 1, wherein the display color change mode is a display state less likely to impair dark adaptation of a user compared to a case in which the display color change mode is not set.

6. The display apparatus according to claim 1, wherein the display color change mode is a display state in which a blue component is set lower compared to a case in which the display color change mode is not set.

7. The display apparatus according to claim 1, wherein the display color change mode is a display state using red or orange, and not using white.

8. The display apparatus according to claim 7, wherein the specific operation includes any of an operation of shaking the display apparatus, an operation of touching a predetermined place on the display apparatus, voice recognition, a predetermined gesture operation performed using a touch panel, an operation of covering a touch panel screen with a hand, and an operation of simultaneously pressing a plurality of operation members, which are operations by which the display color change mode can be released without viewing a display of the display.

9. The display apparatus according to claim 1, wherein the specific operation is a long press of a specific operation member.

10. The display apparatus according to claim 9, wherein according to a short press of the specific operation member, the control unit switches to one of a plurality of display modes having different types and numbers of displayed information pieces.

11. The display apparatus according to claim 1, wherein in a case in which the display color change mode is released according to the specific operation, a display luminance is set to a preset display luminance set by a user.

12. The display apparatus according to claim 1, wherein in a case in which the display color change mode is released according to the specific operation, a display luminance is set to a display luminance brighter than a preset display luminance set by a user, or a brightest display luminance among display luminances that can be set.

13. The display apparatus according to claim 1, wherein the at least one memory and processor or circuit perform operation of a brightness setting unit configured to set the display brightness of the display to one brightness level among a plurality of brightness levels based on an operation that includes an operation of selecting a luminance setting item, which is different from the specific item among the plurality of items displayed on the display.

14. A display apparatus comprising:

a display; and at least one of: a memory and at least one processor, or at least one circuit, to perform operations of units including:

a setting unit configured to set a display color change mode to keep a dark adaptation state of a user from being completely released, wherein the display color change mode is a display mode in which a display color is changed from a mode which is not the display color change mode; and a control unit configured to, in a case where the display color change mode is not set by the setting unit, perform control to increase a display brightness of the display according to a specific operation being performed, and in a case where the display color change mode is set by the setting unit, perform control to release the display color change mode according to the specific operation being performed, wherein in a case in which the display color change mode is set, and a power supply of the display apparatus is turned off and then turned on again, the setting unit maintains setting of the display color change mode.

15. A control method of a display apparatus having a display and an operation member, the control method comprising:

displaying, on the display, a plurality of items including a specific item for setting a display color change mode to keep a dark adaptation state of a user from being completely released;

setting the display color change mode to keep the dark adaptation state of the user from being completely released based on an operation that includes an operation of selecting the specific item among the plurality of items displayed on the display, wherein the display color change mode is a display mode in which a display color is changed from a mode which is not the display color change mode;

performing control to, in a case where the display color change mode is set, release the display color change mode according to a specific operation on the operation member excluding an operation of selecting any of the plurality of items displayed on the display;

in a case in which the display color change mode is set, and a power supply of the display apparatus is turned off and then turned on again, maintaining the setting of the display color change mode; and in a case where the display color change mode is not set, perform control to increase a display brightness of the display according to the specific operation being performed, and in a case where the display color change mode is set, perform control to release the display color change mode according to the specific operation being performed.

16. A control method of a display apparatus comprising:

setting a display color change mode to keep a dark adaptation state of a user from being completely released by a setting unit, wherein the display color change mode is a display mode in which a display color is changed from a mode which is not the display color change mode;

performing control to, in a case where the display color change mode is not set by the setting unit, increase a display brightness of a display according to a specific operation being performed, and performing control to, in a case where the display color change mode is set by the setting unit, release the display color change mode according to the specific operation being performed; and in a case in which the display color change mode is set, and a power supply of the display apparatus is turned off and then turned on again, maintaining the setting of the display color change mode.

17. A non-transitory computer-readable storage medium storing a program for causing a computer to function as units comprising:

a display control unit and a setting unit and a control unit of a display apparatus having an operation member, wherein the display control unit performs control such that a plurality of items, including a specific item for setting a display color change mode to keep a dark adaptation state of a user from being completely released, are displayed on a display, the setting unit sets the display color change mode based on an operation that includes an operation of selecting the specific item among the plurality of items displayed on the display, wherein the display color change mode is a display mode in which a display color is changed from a mode which is not the display color change mode, and the control unit, in a case where the display color change mode is set, performs control to release the display color change mode according to a specific operation on the operation member excluding an operation of selecting any of the plurality of items displayed on the display, wherein in a case in which the display color change mode is set, and a power supply of the display apparatus is turned off and then turned on again, the setting unit maintains setting of the display color change mode, and wherein in a case where the display color change mode is not set, the control unit performs control to increase a display brightness of the display according to the specific operation being performed, and in a case where the display color change mode is set, the control unit performs control to release the display color change mode according to the specific operation being performed.

18. A non-transitory computer-readable storage medium storing a program for causing a computer to function as units comprising:

a setting unit and a control unit of a display apparatus, wherein the setting unit sets a display color change mode to keep a dark adaptation state of a user from being completely released, wherein the display color change mode is a display mode in which a display color is changed from a mode which is not the display color change mode, and the control unit, in a case where the display color change mode is not set by the setting unit, performs control to increase a display brightness of a display according to a specific operation being performed, and in a case where the display color change mode is set by the setting unit, perform control to release the display color change mode according to the specific operation being performed, wherein in a case in which the display color change mode is set, and a power supply of the display apparatus is turned off and then turned on again, the setting unit maintains setting of the display color change mode.

19. A display apparatus comprising:

a display; and at least one of: a memory and at least one processor, or at least one circuit, to perform operations of units including:

a display control unit configured to perform control such that a plurality of items, including a specific item for setting a display color change mode to keep a dark adaptation state of a user from being completely released, are displayed on the display;

a setting unit configured to set the display color change mode based on an operation that includes an operation of selecting the specific item among the plurality of items displayed on the display, wherein the display color change mode is a display mode in which a display color is changed from a mode which is not the display color change mode; and a control unit configured to, in a case where the display color change mode is set, perform control to release the display color change mode according to a specific operation excluding an operation of selecting any of the plurality of items displayed on the display, wherein in a case in which the display color change mode is released according to the specific operation, a display luminance is set to a display luminance brighter than a preset display luminance set by a user, or a brightest display luminance among display luminances that can be set.

20. A control method of a display apparatus comprising:

displaying, on a display, a plurality of items including a specific item for setting a display color change mode to keep a dark adaptation state of a user from being completely released;

setting the display color change mode based on an operation that includes an operation of selecting the specific item among the plurality of items displayed on the display, wherein the display color change mode is a display mode in which a display color is changed from a mode which is not the display color change mode;

performing control to, in a case where the display color change mode is set, release the display color change mode according to a specific operation excluding an operation of selecting any of the plurality of items displayed on the display; and in a case in which the display color change mode is released according to the specific operation, setting a display luminance to a display luminance brighter than a preset display luminance set by a user, or a brightest display luminance among display luminances that can be set.

21. A non-transitory computer-readable storage medium storing a program for causing a computer to function as units comprising:

a display control unit and a setting unit and a control unit of a display apparatus, wherein the display control unit performs control such that a plurality of items including a specific item for setting a display color change mode to keep a dark adaptation state of a user from being completely released, are displayed on a display, the setting unit sets the display color change mode based on an operation that includes an operation of selecting the specific item among the plurality of items displayed on the display, wherein the display color change mode is a display mode in which a display color is changed from a mode which is not the display color change mode, and the control unit, in a case where the display color change mode is set, performs control to release the display color change mode according to a specific operation excluding an operation of selecting any of the plurality of items displayed on the display, wherein in a case in which the display color change mode is released according to the specific operation, a display luminance is set to a display luminance brighter than a preset display luminance set by a user, or a brightest display luminance among display luminances that can be set.

22. A display apparatus comprising:

a display; and an operation member;

at least one of: a memory and at least one processor, or at least one circuit, to perform operations of units including:

a display control unit configured to perform control such that a plurality of items including a specific item for setting a display color change mode to keep a dark adaptation state of a user from being completely released, are displayed on the display;

a setting unit configured to set the display color change mode based on an operation that includes an operation of selecting the specific item among the plurality of items displayed on the display, wherein the display color change mode is a display mode in which a display color is changed from a mode which is not the display color change mode; and a control unit configured to, in a case where the display color change mode is set, perform control to release the display color change mode according to a specific operation on the operation member excluding an operation of selecting any of the plurality of items displayed on the display, wherein in a case where the display color change mode is not set, the control unit performs control to increase a display brightness of the display according to the specific operation being performed, and in a case where the display color change mode is set, the control unit performs control to release the display color change mode according to the specific operation being performed.

23. A control method of a display apparatus having a display and an operation member, the method comprising:

displaying, on the display, a plurality of items including a specific item for setting display color change mode to keep a dark adaptation state of a user from being completely released;

setting the display color change mode based on an operation that includes an operation of selecting the specific item among the plurality of items displayed on the display, wherein the display color change mode is a display mode in which a display color is changed from a mode which is not the display color change mode; and performing control to, in a case where the display color change mode is set, release the display color change mode according to a specific operation on the operation member excluding an operation of selecting any of the plurality of items displayed on the display, wherein in a case where the display color change mode is not set, the control unit performs control to increase a display brightness of the display according to the specific operation being performed, and in a case where the display color change mode is set, the control unit performs control to release the display color change mode according to the specific operation being performed.

24. A non-transitory computer-readable storage medium storing a program for causing a computer to function as units comprising:

a display control unit and a setting unit and a control unit of a display apparatus having a display and an operation member, wherein the display control unit performs control such that a plurality of items, including a specific item for setting a display color change mode to keep a dark adaptation state of a user from being completely released, are displayed on the display;

the setting unit sets the display color change mode based on an operation that includes an operation of selecting the specific item among the plurality of items displayed on the display, wherein the display color change mode is a display mode in which a display color is changed from a mode which is not the display color change mode; and the control unit, in a case where the display color change mode is set, performs control to release the display color change mode according to a specific operation on the operation member excluding an operation of selecting any of the plurality of items displayed on the display, wherein in a case where the display color change mode is not set, the control unit performs control to increase a display brightness of the display according to the specific operation being performed, and in a case where the display color change mode is set, the control unit performs control to release the display color change mode according to the specific operation being performed.

25. A display apparatus comprising:

a display; and at least one of: a memory and at least one processor, or at least one circuit, to perform operations of units including:

a setting unit configured to set a display color change mode to keep a dark adaptation state of a user from being completely released, wherein the display color change mode is a display mode in which a display color is changed from the mode which is not the display color change mode; and a control unit configured to, in a case where the display color change mode is not set by the setting unit, perform control to increase a display brightness of the display according to a specific operation being performed, and in a case where the display color change mode is set by the setting unit, perform control to release the display color change mode according to the specific operation being performed.

26. A control method of a display apparatus having a display, the method comprising:

setting a display color change mode to keep a dark adaptation state of a user from being completely released by a setting unit, wherein the display color change mode is a display mode in which a display color is changed from a mode which is not the display color change mode; and in a case where the display color change mode is not set by the setting unit, performing control to increase a display brightness of the display according to a specific operation being performed, and in a case where the display color change mode is set by the setting unit, performing control to release the display color change mode according to the specific operation being performed.

27. A non-transitory computer-readable storage medium storing a program for causing a computer to function as units comprising:

a setting unit and a control unit of a display apparatus having a display;

the setting unit sets a display color change mode to keep a dark adaptation state of a user from being completely released, wherein the display color change mode is a display mode in which a display color is changed from a mode which is not the display color change mode; and the control unit, in a case where the display color change mode is not set by the setting unit, perform control to increase a display brightness of the display according to a specific operation being performed, and in a case where the display color change mode is set by the setting unit, perform control to release the display color change mode according to the specific operation being performed.

* * * * *